US005227085A

United States Patent [19]

Motsenbocker

[11] Patent Number: 5,227,085

[45] Date of Patent: Jul. 13, 1993

[54] WATER-BASED CLEANER CONTAINING TSP, EDTA, ETHYLENE GLYCOL BUTYL ETHER, AND ACETONE

[76] Inventor: Gregg A. Motsenbocker, P.O. Box 5857, Blue Jay, Calif. 92317

[21] Appl. No.: 964,613

[22] Filed: Oct. 22, 1992

Related U.S. Application Data

[63] Continuation-in-part of Ser. No. 829,357, Feb. 3, 1992.

[51] Int. Cl.[5] ..... C11D 7/16; C11D 7/18; C11D 7/50; C11D 17/08

[52] U.S. Cl. ..... 252/99; 252/102; 252/104; 252/139; 252/153; 252/170; 252/171; 252/173; 252/DIG. 14

[58] Field of Search ..... 252/99, 102, 104, 139, 252/153, 170, 171, 173, 527; 252/DIG. 14

[56] References Cited

U.S. PATENT DOCUMENTS

| | | | |
|---|---|---|---|
| 3,413,231 | 11/1968 | Kolodny | 252/171 |
| 3,607,760 | 9/1971 | McIntyre | 252/104 |
| 3,822,212 | 7/1974 | Bryant | 252/136 |
| 3,950,277 | 4/1976 | Stewart | 252/541 |
| 4,242,217 | 12/1980 | Westermann | 252/135 |
| 4,416,793 | 11/1983 | Barrat | 252/117 |
| 4,485,028 | 11/1984 | King | 252/99 |
| 4,774,015 | 9/1988 | Slover | 252/111 |
| 4,780,235 | 10/1988 | Jackson | 252/170 |
| 4,863,525 | 9/1989 | Goel | 252/170 |
| 4,927,556 | 5/1990 | Pokorny | 252/173 |
| 5,062,988 | 11/1991 | Dishart | 252/170 |
| 5,080,831 | 1/1992 | Van Eenam | 252/558 |
| 5,102,573 | 4/1992 | Han | 252/153 |
| 5,188,675 | 2/1993 | Dorman-Brailsford | 134/4 |

FOREIGN PATENT DOCUMENTS

| | | | |
|---|---|---|---|
| 59-202300 | 11/1984 | Japan | 252/139 |

*Primary Examiner*—Dennis Albrecht
*Attorney, Agent, or Firm*—Donald D. Mon

[57] ABSTRACT

Water-based cleaning compositions for removing a variety of stains or deposits from a variety of substrates, the compositions consisting by weight essentially of tri-sodium phosphate (TSP) between about 0.85% and about 3.5%; ethylene diamine tetra acetic acid (EDTA) and/or phytic acid or a mixture of them between about 0.9% and about 9.0%; ethylene n-butyl ether (glycol EB) and/or butyl salicylate or a mixture of them between about 2.27% and about 27.00%; and acetone and/or a member of the group consisting of dimethyl adipate, dimethyl glutarate, dimethyl succinate or a mixture of them in water, between about 2.0% and 18.00%, and water to make 100%. Such composites may further contain minor amounts of acetic acid, hydrogen peroxide or both.

15 Claims, No Drawings

WATER-BASED CLEANER CONTAINING TSP, EDTA, ETHYLENE GLYCOL BUTYL ETHER, AND ACETONE

CROSS REFERENCE TO CO-PENDING APPLICATION

This is a continuation-in-part of applicant's presently co-pending patent application Ser. No. 07/829,357, filed Feb. 3, 1992, entitled "Cleaner Containing TSP, EDTA, Ethylene Glycol Butyl Ether, and Acetone" (as amended).

FIELD OF THE INVENTION

Cleaning compositions to remove from surfaces such as carpets, cloth, hard surfaces, leather and suede, deleterious deposits and stains so as to restore them as closely as possible to a clean condition.

BACKGROUND OF THE INVENTION

Porous surfaces, such as those of carpets, clothing, tablecloths, napkins, automobile seats, athletic shoes, leather, suede, and certain metal and metal composites, to name only few, and hard surfaces such as concrete, stucco, metal signs, tile, wallpaper and wood floors, often receive deleterious deposits, stains, and graffiti. Such deposits vary widely in their identity. Some may be quite viscous, for example paints, greases, and sauces such as mustard, catsup, and mayonnaise. Others are more liquid in nature, such as pet stains, wines, soft drinks, ball point inks, marker inks, fountain pen inks, and printers inks. Still others may be more solid or pasty, including foods, especially proteinaceous foods, water-based adhesives, and latex-based paints. The term "deposit" includes all of the foregoing, including stains caused by liquids and solids.

Some types of hard surfaces often have deposits respective to their storage and preservation. Examples are oily compositions to protect them from corrosion, residues from cutting oils for which a degreaser is usually needed, and dust on disc brakes which must be removed.

The above recitation exemplifies a broad range of materials which need to be cleaned of a broad range of deposits and stains. In response to this need, an equally wide range of cleaning compositions already exists in the market.

Generally speaking, commercial compositions are limited both in the range of their effectiveness, and also as to how efficient they really are for their intended purpose. If one intends to remove a wide range of kinds of deposits, he is likely to find a nearly-equal number of formulations to buy for the purpose. In addition, some of the stains and deposits are usually only partially removed, and with risk to the material being cleaned. On the consumer market today, for example, there is no known composition which will remove marking pen dye from a white tablecloth. This product will.

Furthermore, many existing compositions are objectionable from an environmental standpoint. This compostion is water-based, and is environmentally acceptable.

It is an object of this invention to provide a water-based environmentally acceptable, biodegradable cleaning composition which can be used to remove a surprisingly wide range of types of deposits and stains. Any residue of these compositions which might remain on the surface, or in the substrate underlying it, will not adversely affect the user or the surface to which it was applied. It has proved to be a considerable surprise to observe how many types of really difficult stains and deposits these compositions can remove, with little or no remaining evidence that there ever had been a stain or a deposit, or that the composition ever had been applied, all without damage to the material being cleaned.

It is another object to provide a small family of related compositions, with somewhat different concentrations of some of the same ingredients, which between them can attend to all but a few of the types of deposits and stains which predictably will be experienced. As few as two or three such related individual formulations will provide nearly optimum removal of a very broad assortment of deposits.

BRIEF DESCRIPTION OF THE INVENTION

A composition according to this invention which provides for a wide range of applications is water-based and comprises, in addition to water: tri-sodium phosphate; EDTA(Ethylene diamine tetro acetic acid) and/or phytic acid or a mixture of them; glycol EB(ethylene diamine tetra acetic acid) and/or butyl salicylate or a mixture of them; and acetone and/or a member of the group consisting of dimethyl adipate, dimethyl glutarate, dimethyl succinate or a mixture of them. In this specification, the term glycol EB means ethylene glycol n-butyl ether, and the term EDTA means ethylene diamine tetra acetic acid.

The range of effectiveness of this composition can be greatly extended by the addition of hydrogen peroxide. When this is added, fluid inks, marker inks, and ball point inks, are better removed and often decolorized, which for clothing achieves the desired stain removal.

According to an optional feature of the invention, the hydrogen peroxide is added to the basic formulation either at the time of packaging, or at the time of application, which provides for valuable improvement of performance on certain stains and deposits. When provided at the time of application, shelf life is improved.

According to yet another optional feature of the invention, discoloring of the composition may largely be avoided by replacing some of the formulation with a minor amount of acetic acid, thereby increasing the attractiveness of the product and thereby extending its salable shelf life

DETAILED DESCRIPTION OF THE INVENTION

This product consists essentially of a member of each of the following groups of ingredients:

a. Trisodium phosphate (TSP)
b. EDTA, or phytic acid, or a mixture of them
c. Ethylene glycol butyl ether (Glycol EB) or butyl salicylate, or a mixture of them.
d. Acetone or a dibasic ester selected from the group consisting of dimethyl adipate, dimethyl glutarate, and dimethyl succinate, or a mixture of them with or without acetone.
e. Water The proportions of the member or members in each group in the ultimate product are in part determined by the application for which the product is intended. There is a surprisingly versatility in this combination of constituents. Variations within defined ranges will in every case provide some useful cleaning operation. However, depending on the targeted substances, and on the substrates from which a deposit is to be removed, remarkable improvements can be secured by varying the relative proportions of the constituents, and when appropriate using one constituent in a group instead of, or along with another in that same group.

For example, there is an economically targeted first group of stains and deposits that are likely to be encountered on clothing, carpets and furniture which have a water or a protein base. These occur principally as the consequence of inadvertencies of people and household pets who spill or slop things. Examples are such as beverage stains—fruit juices, coffee, tea, Kool Aid (a particularly difficult stain for conventional cleaners), red wine, liquor, milk and yogurt; condiments such as ketchup, mustard, mayonnaise, and spaghetti sauces; and various other substances such as chocolate, vomit, feces, blood, grass stains, pet stains, berry stains, dirt, Play Doh, and perspiration:

Removal of these targeted substances, especially when on cloth substrates, is favored by providing a somewhat lesser percentage of groups a,c, and d, and a somewhat larger percentage of group b and e.

There is another, second class of substances to be removed, which while somewhat soluble or releasable in water, are not generally amenable to removal with many or even most water-based cleaners, while they are treatable with the cleaner of this invention. Generally, these substances will at some time have been related more to the kinds of chemicals that contain or contained organic solvents. Examples of this second group of substances are inks from writing and marking instruments, newsprint, paints, hi-liters, nail polish, stains, dyes and dust. They are often encountered on walls, metal signs, varnish and lacquer surfaces, tire sidewalls, automotive brake discs, metal parts, and tennis shoes, for example.

These types of substances are best removed by a cleaner with a relatively higher concentration of groups a,c and d, and a relatively lower concentration of groups b and e.

The substrates to be cleaned from the first group of examples are generally more delicate than those of the latter. They are found on cloth substrates, and generally around the house and wearing apparel. It is interesting to observe that formulation appropriate to them are generally sufficiently dilute that they do no harm to most such substrates. In fact, in many situations it is not even necessary to rinse them off, although this will usually be the best practice.

As to the second set of examples, they are likelier to exist on more solid and substantial substrates. In these concentrations, more attention will generally be given to rinsing off the cleaner and the material it releases, and in general the cleaner used for these applications will be thought of as "stronger".

In all cases, the cleaner can be applied as a liquid, and if desired and feasible the substrate could be submerged in the cleaner. In some situations, especially on porous substrates such as concrete, stucco or brick from which graffiti is to be removed, it may instead be sprayed on, or be applied as an aerosol.

Solutions of the type contemplated by this invention tend to become cloudy unless steps are taken to avoid it. A cloudy solution is still as effective, but is less attractive to a potential purchaser. Cloudiness can largely be avoided by using de-ionized water in the formulation.

The removal of some stains and deposits is improved by the inclusion of hydrogen peroxide in the formulation. This is particularly helpful in the removal of certain ink and paints, marker pen ink, for example. In specifying the addition of hydrogen peroxide, the proportions of the remainder of the ingredients relative to one anothe will not be changed. When added, it will be added to the formulation as otherwise specified, simply replacing an equal volume of it.

Under some circumstances, and in some ranges of concentrations, the formulation over time shows a tendency to discolor. While the cleaning capacity remains good, the product is less attractive to a purchaser, thereby reducing its shelf life in the store. This tendency can largely be overcome by the addition of a minor amount of acetic acid to the solution. In specifying the addition of acetic acid, the same considerations are used for specifying proportions as described above for when the hydrogen peroxide is added.

This is a water-based product. Percentages specified herein are in weight percentage of the total composition. However, in mixing the formulations to make the product, it is best practice to dissolve certain of the ingredients in water before adding them into the total formulation. If all of the ingredients are added to the water at one time, occasionally a clear solution might not result.

For this reason it is preferred practice to dissolve the TSP in water before adding the other ingredients. A TSP:Water ratio (again by weight) of between about 1:12 to about 1:40 is suitable and useful for mixing. An optimal ratio for this purpose is 1:20.

Similarly, EDTA is best supplied not as a dry product, but in a diluted form, about 34% EDTA to about 66% water. This is readily available in industrial concentration.

The other ingredients are either already liquid or readily dissolved, so as to enter the solution or be miscible with it. No special procedure is necessary as to them.

The ingredients of these formulations are commercially available. Certain of these are and identified as follows:

TSP—trisodium phosphate, Cast No. 101-89-0

EDTA—ethylenediamine tetra acetic acid-industrial grade 34% EDTA in water. Cast No. 64-02-8

Glycol EB—ethylene glycol mono butyl ether (2 butoxy ethanol). Cast No. 111-76-2

Acetone—Cast No. 67-64-1

Glacial acetic acid-Cast No. 64-19-17

De-ionized water

The above, and other ingredients, are readily obtainable commercially.

In all the the formulations and guidelines given below, at least one substance from each group must be included.

General Formulation a. trisodium phosphate, between about 0.85% and about 3.5% b. EDTA or phytic acid, or a mixture of them between about 0.9% and about 9.0% c. ethylene glycol butyl ether, or butyl salicylate or a mixture of them between about 2.27% and about 27.0% d. acetone or a dibasic ester or esters selected from the group consisting of dimethyl adipate, dimethyl glutarate, and dimethyl succinate, or a mixture of them with or without acetone, between about 2.0% and about 18.0%, and e. water to make 100%

Preferred general use formulation a. trisodium phosphate, about 1.75%
b. EDTA or phytic acid, or a mixture of them about 9.0%
c. ethylene glycol butyl ether (glycol ether EB) or butyl salicylate or a mixture of them, about 15.4%
d. acetone, or a dibasic ester selected from the group consisting of dimethyl adipate, dimethyl glutarate, and dimethyl succinate, or a mixture of them with or without acetone, about 6.3%; and
e. Water to make one hundred percent.

Preferred modified formulation for certain deposits a. trisodium phosphate, about 2.1%
b. EDTA or phytic acid, or a mixture of them, about 4.5%
c. ethylene glycol butyl ether (glycol ether EB) or butyl salicylate, or a mixture of them about 18.1%
d. acetone, or a dibasic ester selected from the group consisting of dimethyl adipate, dimethyl glutarate, and dimethyl succinate, or a mixture of them with or without acetone, about 8.2%; and
e. Water to make one hundred percent.

Especially preferred embodiments of the above formulations employ, as indicated previously, the following commercial materials: tri-sodium phosphate, EDTA, glycol EB, and acetone in the amounts specified. In preparing the foregoing formulations the TSP is first dissolved in de-ionized water in a weight ratio of 1:20 TSP:water.

It is convenient to define the formulations in 22 ounce quantities, because these will be contained in a conventional-size container. When acetic acid is used, up to one ounce of glacial acetic acid, will be used instead of and in place of one ounce of the formulation. This is a "minor amount", and one which will retard or prevent discoloring of the cleaner.

When hydrogen peroxide is to be used, it will be provided instead of and in place of about up to 20% of the cleaner solution. It will be provided in strength of between about 1% and about 5% $H_2O_2$ in water. This is sometimes called a "minor amount" While this can be added to the solution and sold as such, it will be better practice to supply it separately at the time of use, in these proportions. This can be accomplished by mixing in a container, or by mixing in a spray or mixing device which will combine a stream of hydrogen peroxide and the cleaner. A longer shelf life of the product can be anticipated if the cleaner and hydrogen peroxide are kept separate until they are used.

The substitution of various substances in the groups will largely be decided on the basis of economics. All of them are useful in the cleaner, and it is a matter of preference whether to use one or another.

Trisodium phosphate is a well-known cleaning composition. However, in many regions its usage is severely restricted by environmental laws and regulations. It is an advantage of this invention that in the lesser concentrations used in this invention it is acceptable under the most stringent existing laws and regulations. Still, with the other components it provides a very effective cleaning composition.

The combination of components used herein appears to function synergistically, by mechanisms which are not fully understood at this time. What has become apparent is that the total composition functions to a degree of effectiveness much greater than already-known compositions useful for the intended purposes, and that elimination of any of the groups greatly reduces the effectiveness of the composition.

Formulations according to this invention are remarkably versatile and effective for a wide range of deposits and stains on a wide range of substrates. Any residues can readily be removed, so that a clean surface remains. Any surface or substrate can be laundered or rinsed off to remove any residue.

This invention is not to be limited by the embodiments described in the description, which are given by way of example and not limitation, but only in accordance with the scope of the appended claims.

I claim

1. A cleaner for removing deleterious deposits and stains from a substrate, comprising as a weight percentage of the entire formulation:

a. trisodium phosphate (TSP), between about 0.85% and about 3.5%,
b. ethylene diamine tetra acetic acid (EDTA) or phytic acid, or a mixture of them between about 0.9% and about 9.0%,
c. ethylene glycol n-butyl ether (glycol EB), or butyl salicylate or a mixture of them between about 2.27% and about 27.00%,
d. acetone or a dibasic ester or esters selected from the group consisting of dimethyl adipate, dimethyl glutarate, and dimethyl succinate, or a mixture of them with or without acetone, between about 2.0% and about 18.0%, and
e. water to make 100%.

2. A cleaner according to claim 1 which further includes a minor amount of acetic acid.

3. A cleaner according to claim 1 which further includes a minor amount of hydrogen peroxide.

4. A cleaner according to claim 3 which further includes a minor amount of acetic acid.

5. A cleaner according to claim 1 wherein component (b) is EDTA, component (c) is glycol EB, and component (d) is acetone.

6. A cleaner for removing deleterious deposits and stains from a substrate, comprising by weight percentage of the entire formulation:

a. trisodium phosphate (TSP), about 1.75%
b. ethylene diamine tetra acetic acid (EDTA) or phytic acid, about 9.0%
c. ethylene glycol n-butyl ether (glycol ether EB) or butyl salicylate or a mixture of them, about 15.4%
d. acetone, or a dibasic ester selected from the group consisting of dimethyl adipate, dimethyl glutarate, and dimethyl succinate, or a mixture of them with or without acetone, about 6.3%
e. water to make one hundred percent.

7. A cleaner according to claim 6 which further includes a minor amount of acetic acid.

8. A cleaner according to claim 6 which further includes a minor amount of hydrogen peroxide.

9. A cleaner according to claim 8 which further includes a minor amount of acetic acid.

10. A cleaner according to claim 6 wherein component (b) is EDTA, component (c) is glycol EB, and component (d) is acetone.

11. A cleaner for removing deleterious deposits and stains from a substrate, comprising by weight percentage of the entire formulation:

a. trisodium phosphate (TSP), about 2.1%
b. ethylene diamine tetra acetic acid (EDTA) or a mixture of the, about 4.5%
c. ethylene glycol n-butyl ether (glycol ether EB) or butyl salicylate, or a mixture of them about 18.1%
d. acetone, or a dibasic ester selected from the group consisting of dimethyl adipate, dimethyl glutarate, and dimethyl succinate, or a mixture of them with or without acetone, about 8.2%; and
e. water to make one hundred percent.

12. A cleaner according to claim 11 which the solution further includes a minor amount of acetic acid.

13. A cleaner according to claim 11 in the solution further includes a minor amount of hydrogen peroxide.

14. A cleaner according to claim 13 in which includes a minor amount of acetic acid.

15. A cleaner according to claim 11 wherein component (b) is EDTA, component (c) is glycol EB, and component (d) is acetone.

* * * * *